US007111368B2

(12) United States Patent
Matoba

(10) Patent No.: US 7,111,368 B2
(45) Date of Patent: Sep. 26, 2006

(54) BUCKLE

(75) Inventor: Hiroshi Matoba, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/653,438

(22) Filed: Sep. 2, 2003

(65) Prior Publication Data

US 2004/0055122 A1 Mar. 25, 2004

(30) Foreign Application Priority Data

Sep. 20, 2002 (JP) ..... P. 2002-274334
May 20, 2003 (JP) ..... P. 2003-142191

(51) Int. Cl.
*A44B 11/25* (2006.01)

(52) U.S. Cl. ..... 24/615; 24/614; 24/625

(58) Field of Classification Search ..... 24/614–622, 24/625, 629, 633, 662
See application file for complete search history.

(56) References Cited

U.S. PATENT DOCUMENTS

| | | | | | |
|---|---|---|---|---|---|
| 4,150,464 | A * | 4/1979 | Tracy | 24/615 |
| 4,631,787 | A * | 12/1986 | Kasai | 24/616 |
| 4,639,982 | A | 2/1987 | Kasai | 24/626 |
| 4,688,337 | A | 8/1987 | Dillner et al. | 24/616 |
| D297,423 | S * | 8/1988 | Kong | D11/216 |
| D353,560 | S * | 12/1994 | Rekuc | D11/216 |
| 5,465,472 | A * | 11/1995 | Matoba | 24/625 |
| 6,052,875 | A | 4/2000 | Fudaki | 24/625 |
| 6,421,889 | B1 | 7/2002 | Chien | 24/614 |
| 6,571,433 | B1 * | 6/2003 | Uehara et al. | 24/625 |
| 6,615,460 | B1 * | 9/2003 | Baumgarten | 24/625 |
| 6,662,414 | B1 * | 12/2003 | Niewiadomski | 24/625 |
| D491,102 | S * | 6/2004 | Matoba et al. | D11/216 |
| 6,760,958 | B1 * | 7/2004 | Tejima | 24/616 |

FOREIGN PATENT DOCUMENTS

| | | | |
|---|---|---|---|
| EP | 0 467 574 | A1 * | 1/1992 |
| JP | 55-23601 | | 6/1980 |
| JP | 407051106 | A * | 2/1995 |
| JP | 407155207 | A * | 6/1995 |
| JP | 407255510 | A * | 10/1995 |
| JP | 2533866 | | 1/1997 |
| JP | 409206113 | A * | 8/1997 |
| JP | 2001061513 | A * | 3/2001 |

* cited by examiner

*Primary Examiner*—Robert J. Sandy
*Assistant Examiner*—Ruth C. Rodriguez
(74) *Attorney, Agent, or Firm*—Everest Intellectual Property Law Group; Michael S. Leonard

(57) ABSTRACT

A buckle body formed of a resin has a housing having an insertion port on one end, an opening portion on both sides and an engaged portion in an inner part, an insertion member is provided with a pair of flexible insertion leg portions including an engaging portion on one end, an operating rod extended like a cantilever from a tip is continuously provided on the outside of the insertion leg portion and a mechanism capable of suppressing inward and outward deformations of the leg portion within a constant rage is provided, and the operating rod is provided with an operating portion protruded outward from the opening portion disposed on the buckle body at time of an insertion into the buckle body, and the insertion leg portion is deformed by pressing to disengage the engaging portion from the engaged portion, thereby removing the insertion member from the buckle body.

12 Claims, 11 Drawing Sheets

BUCKLE

BACKGROUND OF THE INVENTION

1. Field of the Invention

The present invention relates to a buckle of an insertion type having a housing-shaped buckle body and an insertion member including a leg portion formed by a projection piece for an insertion, and particularly to a buckle for a belt which is generally used in clothes, bags, helmets or sporting goods.

2. Description of the Related Art

As shown in FIG. 15, there has conventionally been known a buckle of an insertion type having a housing-shaped buckle body 101 and an insertion member 151 including an insertion leg portion 153. The insertion member 151 is provided with an insertion leg portion 153 on one of the ends of a board 155, in which a projection-shaped engaging portion 157 is provided on both sides of the tip of the insertion leg portion 153, and furthermore, an operating portion 159 overhung toward the side is provided on outside surfaces at both sides of the leg portion. The buckle body 101 is formed by a flat cylindrical box 103 as a whole, in which an insertion port 105 is provided on one of ends and an opening portion 107 cut like a circular arc is provided on outside surfaces at both sides, a projection-shaped engaging portion 157 is provided on both left and right sides of internal surfaces at both sides. When the insertion leg portion 153 is inserted, the engaging portions of the insertion member 151 and the buckle body 101 are respectively engaged, and disengagement can be carried out by pressing the operating portion 159 (for example, see Japanese Utility Model Registration No. 2533866).

As shown in FIG. 16, moreover, there has been known a buckle having a first fixing member 201 and a second fixing member 213. The first fixing member 201 has a base portion 221 having a belt attachment hole 223 on one of ends and a cover member 211 having a U-shaped section which includes a pair of engagement projections in an inner part and an engagement hole 207 provided on the tip side of the engagement projection to fit and engage the engagement piece of a horn, and both sides and a front surface which are opened. The second fixing member 213 has a horn 217 provided with an engagement piece 209 which has a circular arc portion bulged outward which can be engaged on the inside with the engagement projection of the cover member 211 on the outside surface of a tip at the front surface of the base portion 203 having a belt attachment hole 215 on one of ends and has a connected portion 205 protruded outward like a hook. The second fixing member 213 is engaged with the opening of the cover member 211 by fitting an insertion engagement piece 209 in the engagement hole 207, and furthermore, a wide press plate 219 having a T-shaped plane is provided on the outside of the center of the horn 217 and the fitting and engaging operation of the engagement hole 207 and the engagement piece 209 can be released by pressing the press plate 219 (for example, see JP-B-55-23601).

Japanese Utility Model Registration No. 2533866 (especially, pages 2 and 3, 0012 to 0015, FIGS. 1 to 4) and JP-B-55-23601 (especially, pages 1 and 2, FIGS. 1 to 6) are known as reference documents.

The buckle for inserting the insertion member into the buckle body, which is disclosed in Japanese Utility Model Registration No. 2533866, has such a configuration that a pair of insertion leg portions 153 provided in the insertion member 151 are prism-shaped and the engaging portion 157 is provided on both sides of a tip, the operating portion 159 protruded from the opening portion 159 of the buckle body 101 is provided in an outer part on the inside of the engaging portion 157, and the leg portion between the operating portion 159 and the board presses the operating portion 159 to carry out an elastic deformation so that the engaging portion 157 of the tip and the engaging portion 157 are disengaged. In order to carry out a smooth engaging/disengaging operation, the elastic deformable part of the leg portion is formed to be long or thin. The size of the buckle has to be increased so as to form the elastic deformable part to be long. For this reason, it is impossible to obtain a small-sized buckle having a good appearance. As a result that the elastic deformable part of the insertion leg portion 153 is formed to be thin, a problem that the thin portion is firstly broken might occur.

In the buckle for inserting the horn of the second fixing member into the cover member of the first fixing member, which is disclosed in JP-B-55-23601, it is necessary to easily carry out the elastic deformation of the horn 217 in a section provided with the press plate 219 from the base portion 203 of the horn 217 in order to smoothly remove the engagement piece 209 from the engagement hole 207 of the engagement projection provided on the cover member 211 by pressing the press plate 219 having a T-shaped plane which is provided on the horn 217 of the second fixing member 213. Accordingly, as this section cannot be shortened, the size of the buckle is increased because of the long shape and the easy elastic deformation. Moreover, since the cover member 211 has a U-shaped section in which the side surface is opened, corners on both sides of the double-sided plate of an open edge in the opening are exposed. In use, therefore, the cover member is caught on other things so that a smooth operation cannot be carried out. In the case that a twist acts on the double-sided plate in an inserting operation, moreover, there is a problem that a breakage might be caused.

SUMMARY OF THE INVENTION

The invention has been made in consideration of the problems. A first object of the invention is to provide a buckle of an insertion type in which the size of the buckle for inserting an insertion member into a buckle body is reduced to finish the buckle having a good appearance, the insertion leg portion of the insertion member can easily be deformed elastically with the small size, and an operation for fitting and removing the insertion member can readily be carried out.

A second object of the invention is, in addition to the first object, to provide a buckle of an insertion type in which the insertion leg portion of the insertion member is smoothly guided and inserted into the buckle body and dust or water entering the buckle body can be discharged quickly even in a state that the insertion member is inserted into the buckle body.

A third object of the invention is, in addition to the first object, to provide a buckle of an insertion type in which a pair of insertion leg portions of the insertion member can be elastically deformed inwardly easily and precisely with a simple structure.

A fourth object of the invention is, in addition to the first object, to provide a buckle of an insertion type capable of maintaining an effective length for elastically deforming the insertion leg portion and having a refined insertion member with a good appearance.

A fifth object of the invention is, in addition to the first object, to provide a buckle of an insertion type in which difference in heights is not formed between the operating portion of an operating rod and the insertion leg portion to cause the operating portion to be caught on other things with difficulty, thereby preventing a breakage.

A sixth object of the invention is, in addition to the first object, to provide a buckle of an insertion type in which a clearance is not formed between the opening portion of the buckle body and the operating portion of the insertion leg portion when the insertion member is inserted, and other things can be prevented from being caught to disturb a pressing operation or a removing operation.

A seventh object of the invention is, in addition to the first object, to provide a buckle of an insertion type in which a clearance between the tip of the operating rod and the base portion of the insertion leg portion is narrow, thereby preventing other things from entering.

An eighth object of the invention is, in addition to the seventh object, to provide a buckle of an insertion type in which a pair of insertion leg portions can easily be deformed and engaged with the buckle body, and the deformation of the insertion leg portion is suppressed to carry out reinforcement with a simple structure in such a manner that the insertion leg portion can be prevented from being excessively bent outward to cause a deformation when outward force is applied to the insertion leg portion, thereby preventing the breakage of the insertion leg portion.

A ninth object of the invention is, in addition to the first object, to provide a buckle of an insertion type capable of preventing the buckle body and the insertion body from being inserted on opposite side by mistake and carrying out a smooth inserting operation.

According to a first aspect of the invention, there is provided a buckle of an insertion type including a buckle body 1, which is a housing 10 formed of a resin, has an insertion port 15 on one end, a belt attachment portion 17 on another end, an opening portion 16 on both sides, and an engaged portion 20 in an inner part respectively, an insertion member 2, which is formed of a resin, has a pair of flexible insertion leg portions 31 including a belt attachment portion 40 on one end and an engaging portion 32 which can be engaged with the engaged portion 20 on a tip at another end side, and an operating rod 33, which is continuously provided on an outside of the insertion leg portion 31, extended like a cantilever from a tip side of the insertion leg portion 31 toward a base end side, wherein the operating rod 33 is provided with an operating portion 34 protruded outward from the opening portion 16 of the buckle body 1 when the insertion member 2 is inserted into the buckle body 1.

According to a second aspect of the invention, in addition to the first aspect of the invention, the engaging portion 32 provided in the insertion member 2 is formed by a projection 45 protruded toward a surface and a back face on the tip of the insertion leg portion 31, and the engaged portion 20 provided in the buckle body 1 is formed by a pair of left and right protruded plates 21 protruded from internal surfaces on both sides of the buckle body 1 and provided apart from each other to have an outward extended shape in such a manner that a space on the belt attachment portion 17 side is small and a space on the insertion port 15 side is enlarged.

According to a third aspect of the invention, in addition to the second aspect of the invention, a hole portion 22 extended straight is formed on tips of the left and right protruded plates 21 provided on a lower plate 12.

According to a forth aspect of the invention, in addition to the first aspect of the invention, a space between the tips of the insertion leg portions 31 provided in the insertion member 2 is small and a space on the base portion 30 side is large, and the insertion leg portion 31 itself is formed to be bent outward from the insertion member 2.

According to a fifth aspect of the invention, in addition to the first aspect of the invention, a slit 35 extended at an almost constant interval is provided between the insertion leg portion 31 of the insertion member 2 and the operating portion 34 of the operating rod 33.

According to a sixth aspect of the invention, in addition to the first aspect of the invention, the operating portion 34 provided on the operating rod 33 is formed to be gradually increased in thickness from the inside edge portion 46 to an outside edge portion 47, and is thicker than the insertion log portion 31.

According to a seventh aspect of the invention, in addition to the first aspect of the invention, the inside edge portion 46 of the operating portion 34 provided on the operating rod 33 is formed to have such a shape as to be almost coincident with an open edge of the opening portion 16 of the buckle body 1 as seen on a plane.

According to an eighth aspect of the invention, in addition to the first aspect of the invention, a projection piece 36 protruded toward a tip of the operating rod 33 is provided on an outside of a pair of the insertion leg portions 31 at the base portion 30 side in the insertion member 2.

According to a ninth aspect of the invention, in addition to the eighth aspect of the invention, the operating portion 34 provided on the insertion leg portion 31 abuts on the projection piece 36 provided on the outside of the base portion 30 of the insertion leg portion 31 when a pair of the insertion leg portions 31 of the insertion member 2 are excessively bent outward, thereby preventing the insertion leg portion 31 from being bent outward.

According to a tenth aspect of the invention, in addition to the first aspect of the invention, a guide rod 37 is protruded from a center of the base portion 30 of the insertion member 2, guide portions 38 and 39 having different shapes from each other and protruded to be convexly provided on a surface and a back face of the guide rod 37, and guide grooves 24 and 25 capable of alternatively guiding the guide portions 38 and 39 are concavely provided on internal surfaces of an upper plate 11 and a lower plate 12 of the buckle body 1 respectively.

BRIEF DESCRIPTION OF THE DRAWINGS

FIG. 12 is a sectional view showing a state in which thee buckle body and the insertion member are engaged with each other, which is partially taken away;

DETAIL DESCRIPTION OF THE PREFERRED EMBODIMENTS

An embodiment of a buckle according to the invention will be specifically described below with reference to the drawings.

Figure 1:
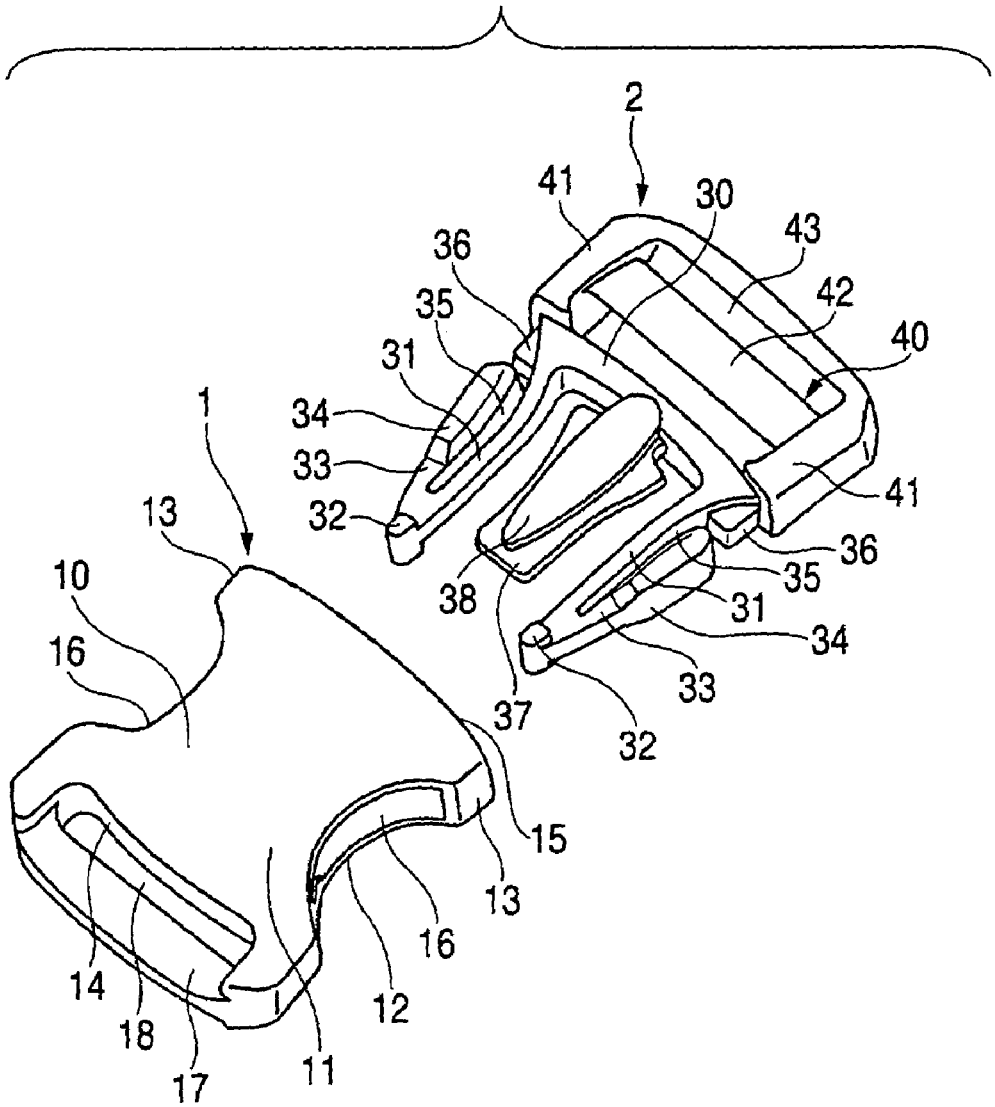
FIG. 1 is a perspective view showing a state in which a buckle body and an insertion member are separated from each other.
Figure 2:
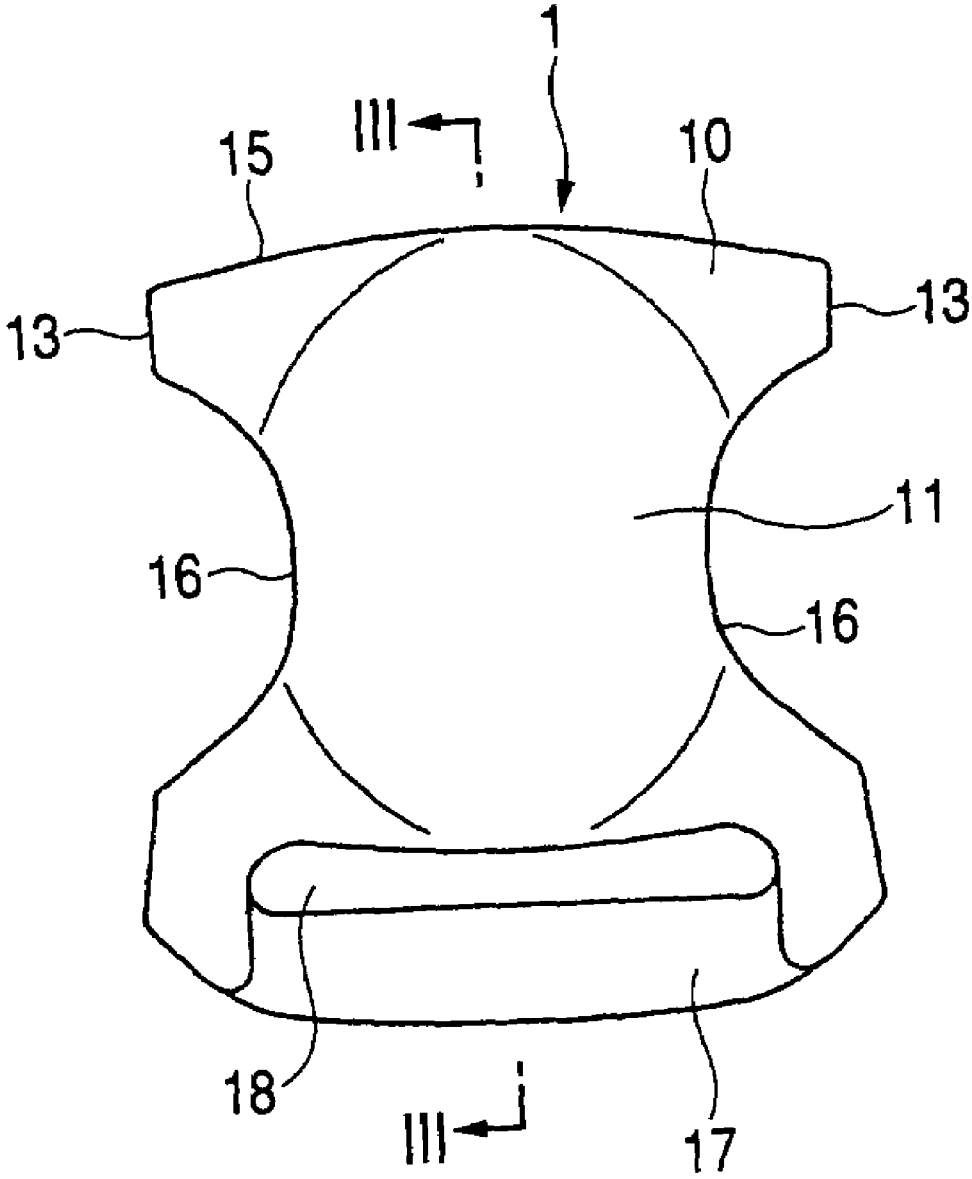
FIG. 2 is a front view showing the buckle body.
Figure 3:
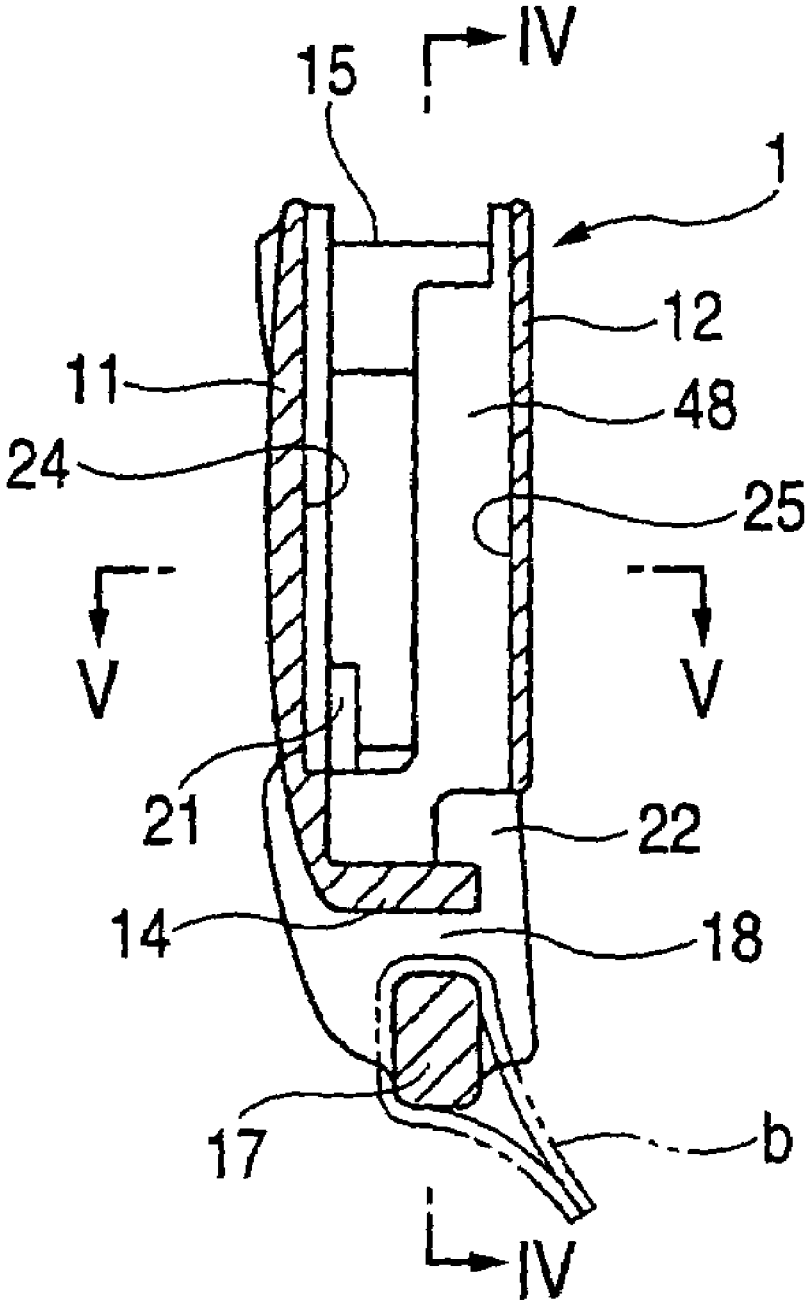
FIG. 3 is a sectional view showing the buckle body, which is taken along a line III—III in FIG. 2.
Figure 4:
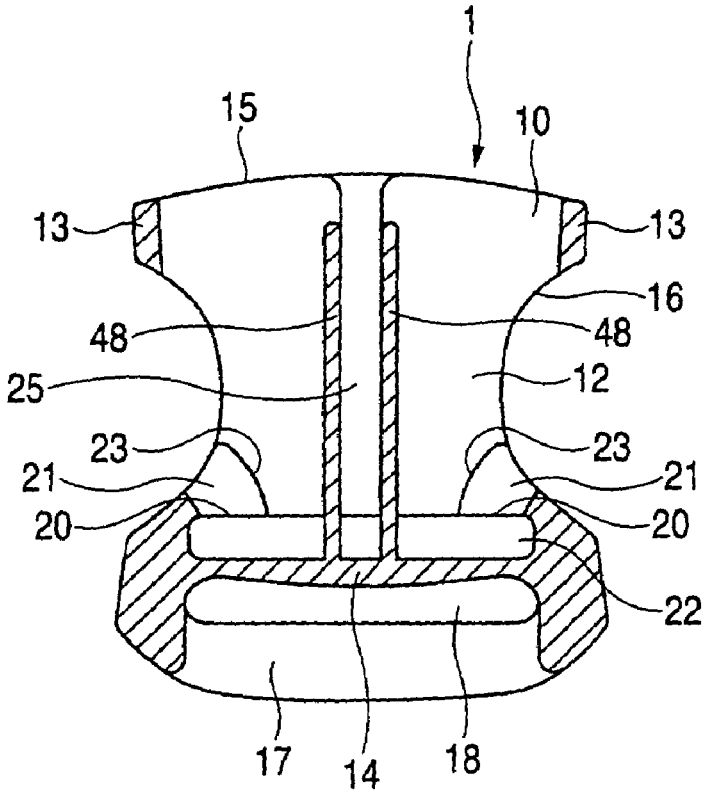
FIG. 4 is a sectional view showing the buckle body, which is taken along a line IV—IV in FIG. 3.
Figure 5:
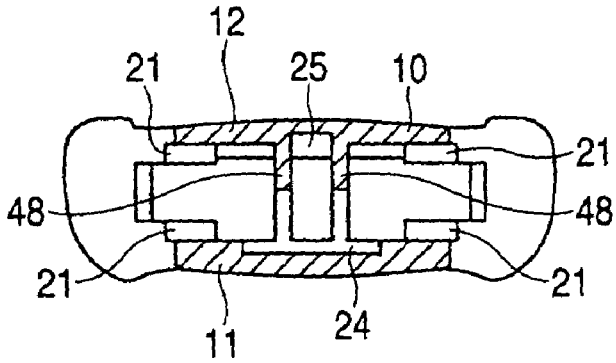
FIG. 5 is a sectional view showing the buckle body, which is taken along a line V—V in FIG. 3.
Figure 6:
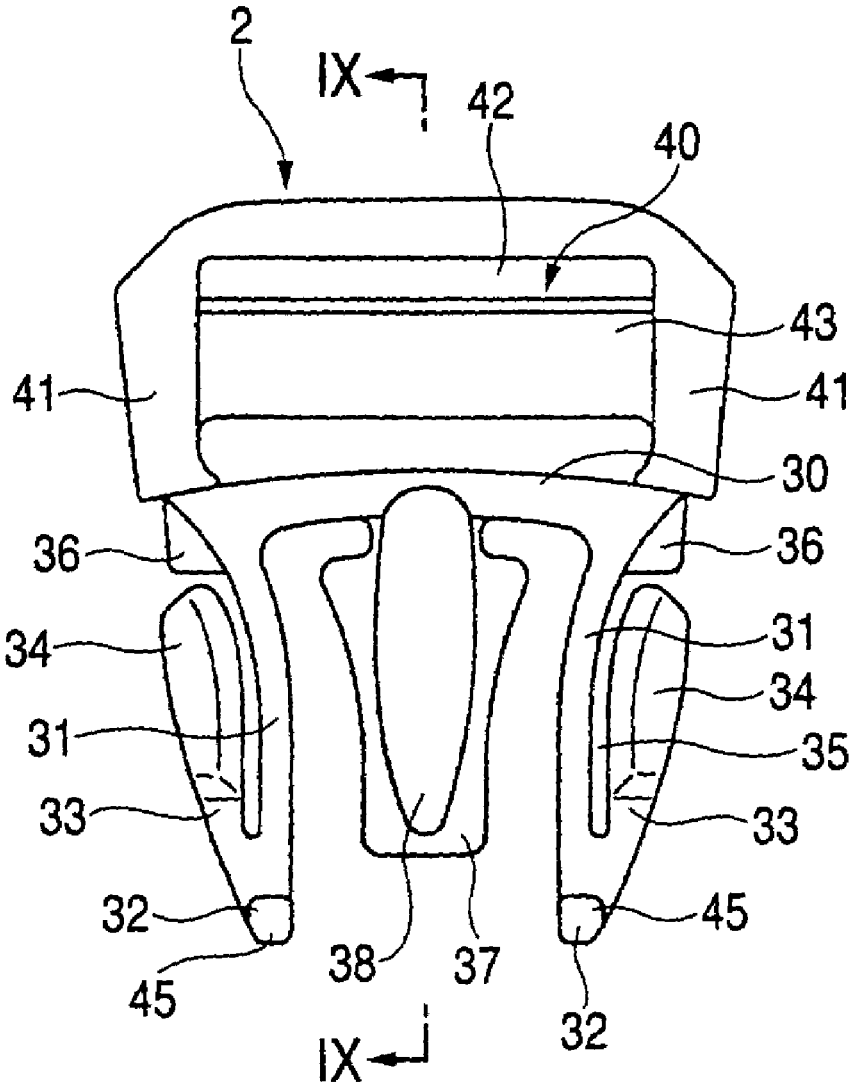
FIG. 6 is a front view showing an insertion member.
Figure 7:
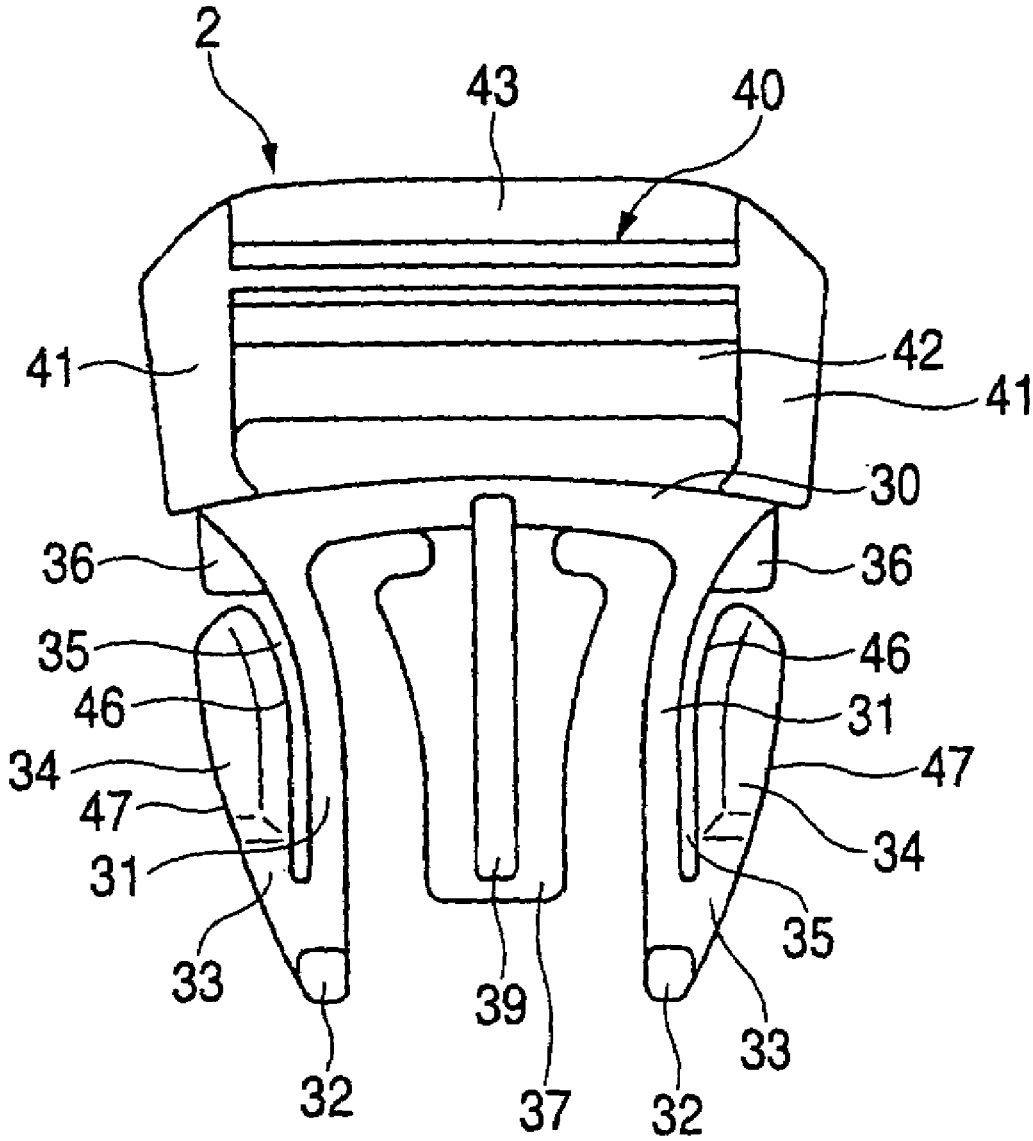
FIG. 7 is a rear view showing the insertion member.
Figure 8:
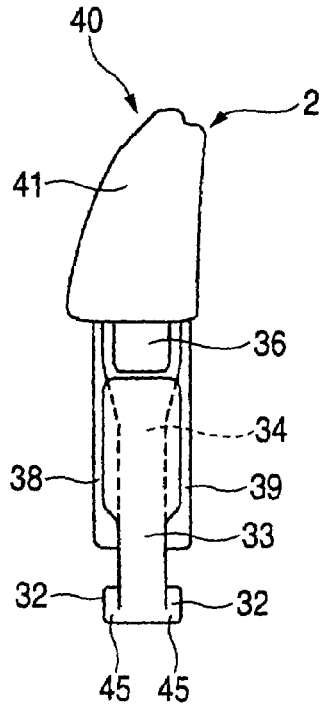
FIG. 8 is a side view showing the insertion member.

The buckle according to the invention is, as shown in FIG. 1, of an insertion type having a buckle body 1 called socket and an insertion member 2 called plug which can be inserted into the buckle body 1. Both the buckle body 1 and the insertion member 2 are formed by injection molding means using a thermoplastic resin, for example, polyamide, polyacetal, polypropylene or polybutylene terephthalate.

As shown in FIGS. 1 to 5, the buckle body 1 forms a housing 10 to enclose an upper plate 11, a lower plate 12, left and right side walls 13 and 13, and a front wall 14. One of the ends of the housing 10 is provided with an insertion port 15 into which the insertion member 2 can be inserted. A circular arc-shaped opening portion 16 is provided on both sides of the housing 10 by partially cutting away the side wall 13, the upper plate 11 and the lower plate 12 toward the inside of the housing 10. A belt insertion hole 18 capable of inserting a belt b is provided on the other end of the housing 10, that is, in the forward part of the front wall 14, and a belt attachment portion 17 is formed to attach one of the ends of the belt b.

The lower plate 12 of the housing 10 is provided with a hole portion 22 extended straight in the transverse direction of the housing 10 in the vicinity of the belt insertion hole 18. A pair of left and right protruded plates 21 protruded to be extended outward from the internal surfaces of the upper plate 11 and the lower plate 12 are provided between the hole portion 22 and the opening portion 16 on both sides. The left and right protruded plates 21 are provided apart from each other in the transverse direction of the housing 10. The outer side edge of the protruded plate 21, that is, the hole portion 22 side forms an engaged portion 20 engaged with an engaging portion 32 because an insertion leg portion 31 of the insertion member 2 is formed to fit a gap of the left and right protruded plates 21 and to engage the engaging portion 32 provided with the insertion leg portion 31. The inside edge of the protruded plate 21, that is, the insertion port 15 side is formed to be a circular arc-shaped guide surface 23 bulged toward the inner part of the housing 10. When the insertion leg portion 31 is inserted in the housing 10, the engaging portion 32 provided on the tip of the insertion leg portion 31 is smoothly giddied to flex and deform the insertion leg portion 31 inward.

A wide concave guide groove 24 for guiding a wide guide portion 38 provided on the upper surface of a guide rod 37 of the insertion member 2 is provided in the vertical direction of the center of an inner surface in the upper plate 11 of the housing 10. A narrow concave guide groove 25 for guiding a narrow guide portion 39 provided on the lower surface of the guide rod 37 of the insertion member 2 is provided in the vertical direction of the center of an internal surface in the lower plate 12. A guide projection 48 is provided along both sides of the guide groove 25 and serves to guide both side surfaces of the guide portion 39. Moreover, a side wall 13 provided on both sides of the insertion port 15 of the housing 10 is formed in such a configuration as to stably hold the projection piece 36 provided on the outside of a base portion 30 of a pair of insertion leg portions 31 of the insertion member 2 without a looseness.

As shown in FIGS. 1 and 6 to 11, the insertion member 2 has a belt attachment portion 40 provided on one end side from the base portion 30 disposed in the transverse direction of the center of the insertion member 2, and has a pair of insertion leg portions 31 provided on the other end side to be inserted into the housing 10 of the buckle body 1. The insertion leg portion 31 is protruded to be bent outward from both sides of the base portion 30 toward a tip, that is, is protruded in such a manner that the space of the tip between a pair of insertion leg portions 31 is reduced and a space on the base portion 30 side is increased, and is formed to be easily flexed inward.

The tips of the insertion leg portions 31 are provided with a projection 45 protruded to a surface and a back face. The projection 45 serves as the engaging portion 32 which can be engaged with the engaged portion 20 provided in the housing 10 of the buckle body 1. An operating rod 33 is continuously provided backward like a cantilever from the tip side of the insertion leg portion 31 toward the base end side, that is, the base portion 30 of the insertion member 2. The tip of the operating rod 33 is provided with an operating portion 34 protruded outward from the opening portion 16 of the housing 10 when the insertion member 2 is inserted in the housing 10 of the buckle body 1.

The operating rod 33 is provided like a cantilever from the tip of the insertion leg portion 31, that is, the engaging portion 32. Consequently, it is possible to increase a range in which the elastic deformation of the insertion leg portion 31 can be carried out. However, the range does not need to be increased excessively but is preferably minimized. Therefore, the buckle has such a feature that a size can be more reduced than that of a conventional product.

Figure 10:
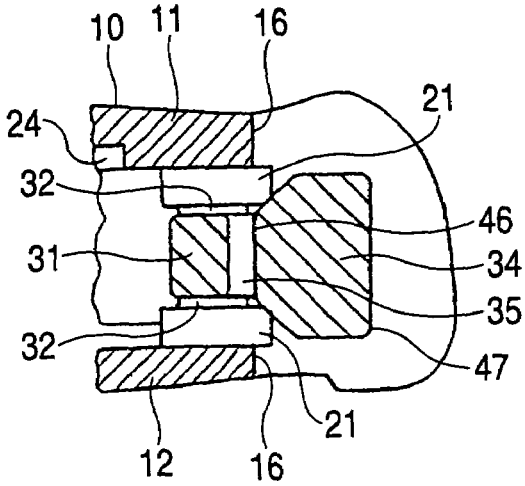
FIG. 10 is a sectional view taken along a line X—X in FIG. 12 in a state in which the buckle body and the insertion member are engaged with each other.

A slit 35 extended in parallel at an almost constant interval is provided between the insertion leg portion 31 and the operating portion 34 in order that the operating portion 34 easily deforms the insertion leg portion 31 elastically. An inside edge portion 46 of the operating portion 34 is almost coincident with the open edge of the opening portion 16 of the housing 10 as seen on a plane, and a tip portion is present in the housing 10 in such a manner that a clearance is not generated between the open edge of the opening portion 16 and the inside edge portion 46 of the operating portion 34. The operating portion 34 is formed to have a smaller thickness than the opening thickness of the opening portion 16 as shown in FIG. 10 Therefore, the insertion leg portion 31 can be flexed and deformed and to freely insert into the housing 10 when the operating portion 34 is pressed, and the engagement of the engaged portion 20 and the engaging portion 32 by the projection piece 21 provided on the internal surface can be released. Moreover, the inside edge portion 46 in the operating portion 34 has a thickness which is equal to that of the insertion leg portion 31, and is inclined toward an outside edge portion 47 to be gradually thicker. The outside surface of the operating portion 34, that is, a surface which comes in contact with fingers when pressing the operating portion 34 is formed to be large.

A plate-shaped projection piece 36 protruded outward toward the tip of the operating portion 34 is provided on both sides of the base portion 30 of the insertion leg portions 31. The projection piece 36 serves to reduce a gap between the base portion 30 and the tip of the operating portion 34 and to hinder other things from entering the slit 35 between the insertion leg portion 31 and the operating rod 33. Moreover, a guide rod 37 protruded forward is provided in the central part of the base portion 30, and guide portions 38 and 39 having different sectional shapes are provided on the surface and back face of the guide rod 37, respectively. For example, the guide portion 38 taking the shape of a bilge is protruded from the surface of the guide rod 37 and the convex guide portion 39 extended straight is protruded from the back face. When the insertion member 2 is inserted into the housing 10, the guide portion 38 and the guide portion are respectively inserted to the wide guide groove 24 and the narrow guide groove 25 which are provided on the internal surfaces of the upper plate 11 and the lower plate 12 in the housing 10 to prevent the insertion member 2 from being rocked, thereby holding a stable state. The shapes of the guide rod 37 and the guide portions 38 and 39 can be changed properly.

Figure 11:
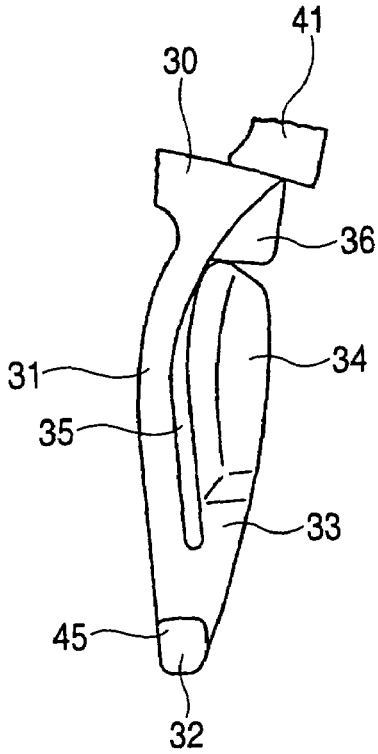
FIG. 11 is a view showing an action in which the insertion leg portion of the insertion member is bent outward.

When the operating portion 34 is pressed inward, a pair of the insertion leg portions 31 provided in the insertion member 2 abut on the side surface of the guide rod 37 provided between the insertion leg portions 31 due to an excessive flexure, thereby suppressing the deformation of the insertion leg portion 31 and preventing the insertion leg portion 31 from being broken. In order to prevent obstacles such as clothes or bags from being caught on the tip of the insertion leg portion 31 of the insertion member 2 or to prevent the insertion leg portion 31 from being excessively bent outward and broken due to an artificial trick in the case that the insertion member 2 is separated from the buckle body 1, moreover, the tip of the operating portion 34 serves to abut on the projection piece 36 provided on the base portion 30 to hinder more backward deformations and to reinforce the insertion leg portion 31 when the insertion leg portion 31 is excessively bent backward as shown in FIG. 11. Even if external force is applied to the buckle inward or outward, accordingly, the excessive deformation is hindered by the guide rod 37 or the projection piece 36 so that the insertion leg portion 31 is protected from a breakage.

Accordingly, it is possible to have such a configuration that the insertion leg portion 31 can be formed to have a small thickness so as to be easily deformed elastically and the operation for pressing the operating portion 34 can simply be carried out.

Figure 9:
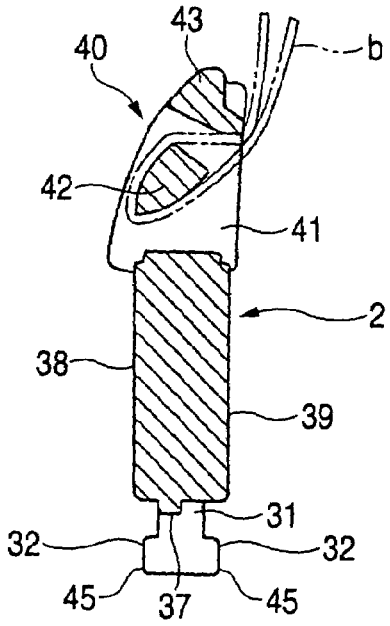
FIG. 9 is a sectional view showing the insertion member, which is taken along a line IX—IX in FIG. 6.

The insertion member 2 has a belt attachment portion 40 provided on the other end side of the base portion 30. The belt attachment portion 40 has an engagement rod 43 capable of engaging a belt provided on the outermost end as shown in FIG. 9 with respect to a side frame 41 protruded from both sides of the base portion 30, and a hooking rod 42 capable of hooking the belt is transversely provided on a center to attach the belt in such a configuration that the length of the other end of the belt can be regulated.

Figure 12:
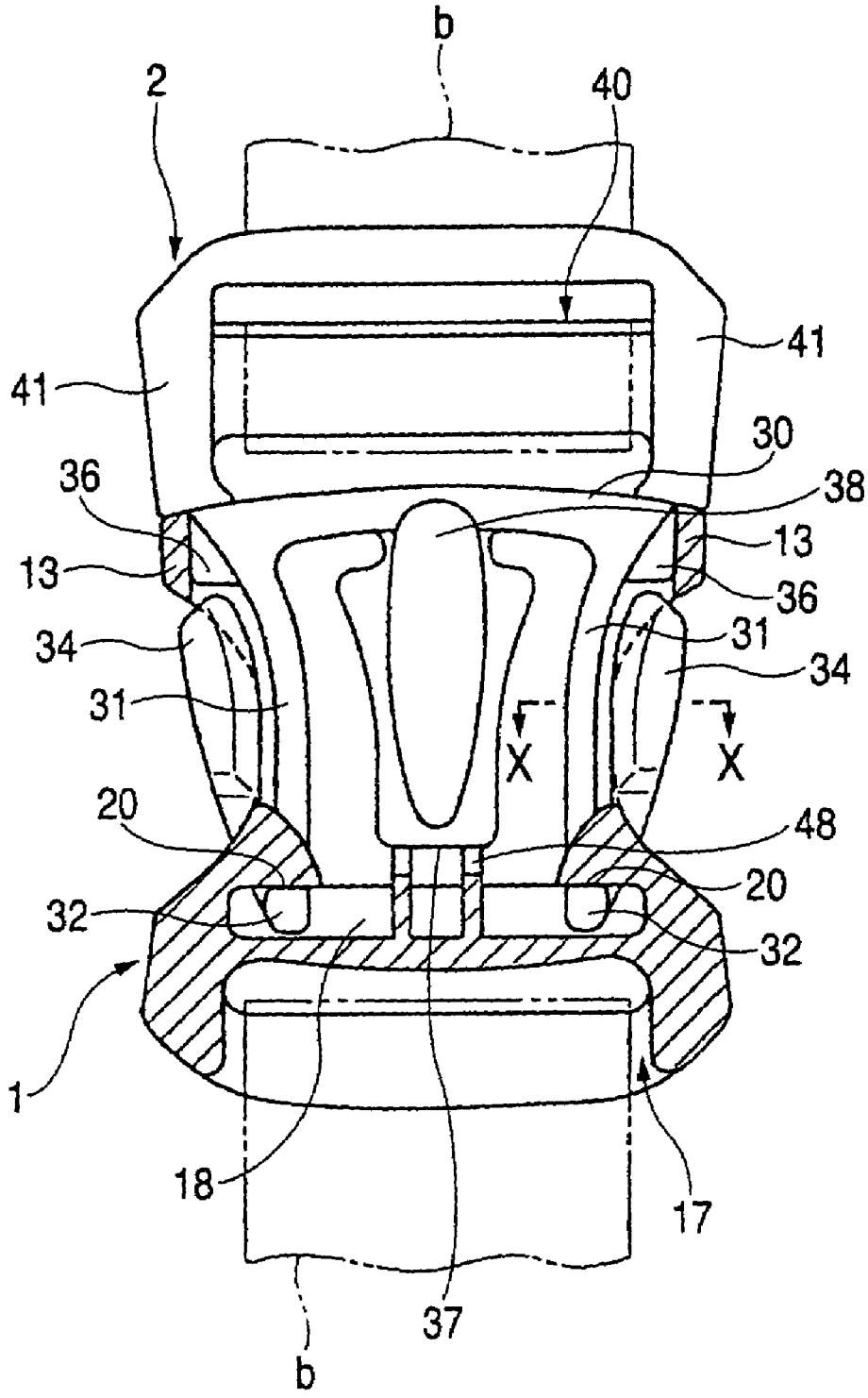
FIG. 12 in a state in which the buckle body and the insertion member are engaged with each other.

Referring to a manner for using the buckle, as shown in FIG. 12, one end of the belt b is attached to the belt attachment portion 17 of the buckle body 1, another end of the belt b is attached to the belt attachment portion 40 of the insertion member 2 in such a manner that a length can be regulated. The insertion leg portion 31 of the insertion member 2 is inserted from the insertion port 15 of the housing 10 of the buckle body 1, and the engaging portion 32 provided on the tip of the insertion leg portion 31 is guided along the circular arc-shaped guide surface 23 of the protruded plate 21 provided in the housing 10. As a result, the insertion leg portion 31 is flexed and deformed and the engaging portion 32 is engaged with the engaged portion 20 so that the buckle body 1 and the insertion member 2 are coupled to each other.

In order to disconnect the buckle body 1 from the insertion member 2, the operating portion 34 of the insertion member 2 inserted in the buckle body 1 is pressed to separate the engaging portion 32 from the engaged portion. Consequently, the insertion member 2 can easily be removed from the housing 10.

Figure 13:
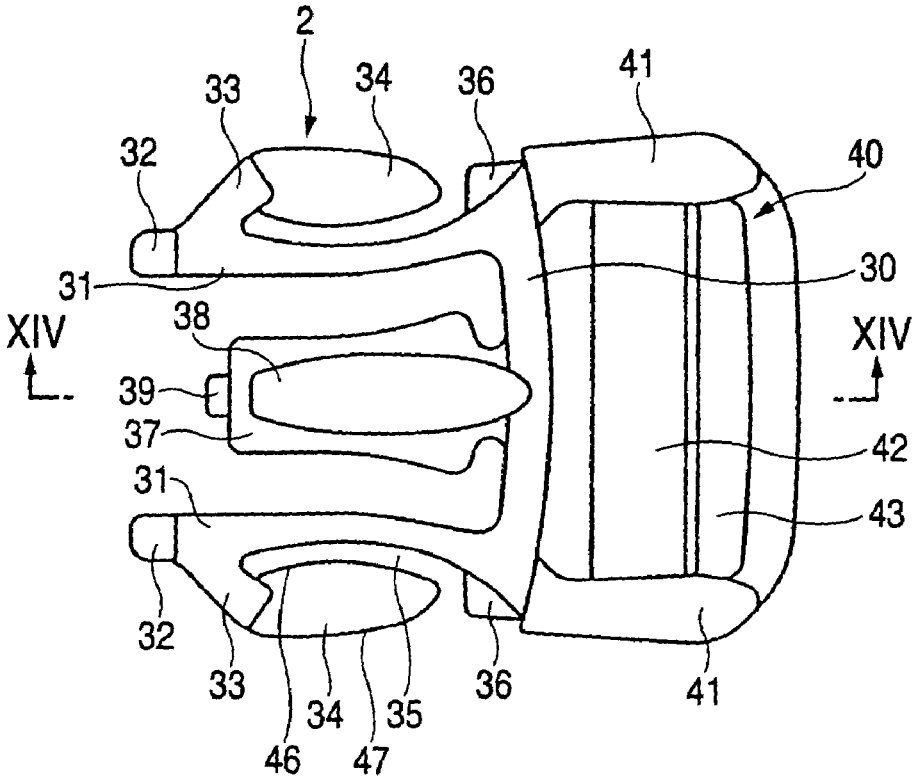
FIG. 13 is a front view showing a variant of the insertion member.
Figure 14:
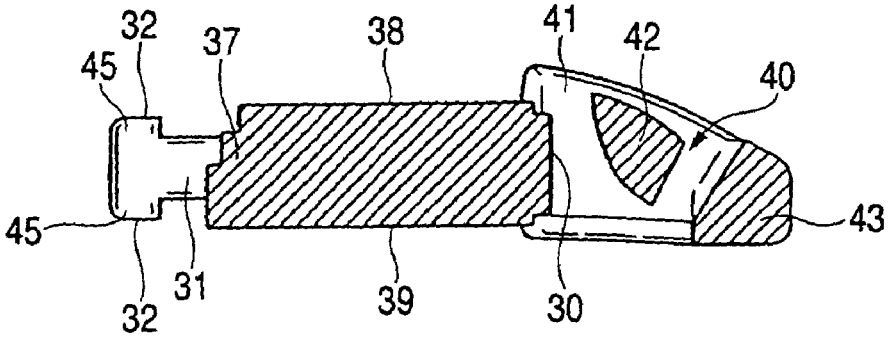
FIG. 14 is a sectional view showing the insertion member, which is taken along a line XIV—XIV in FIG. 13.
Figure 15:
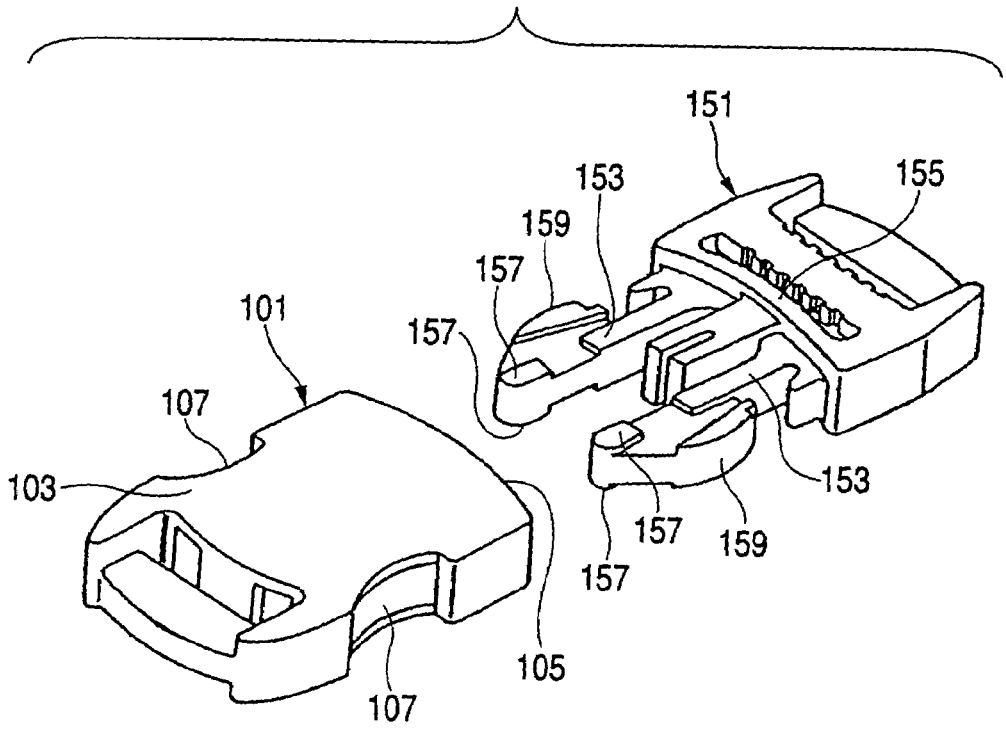
FIG. 15 is a perspective view showing a well-known buckle of an insertion type.
Figure 16:
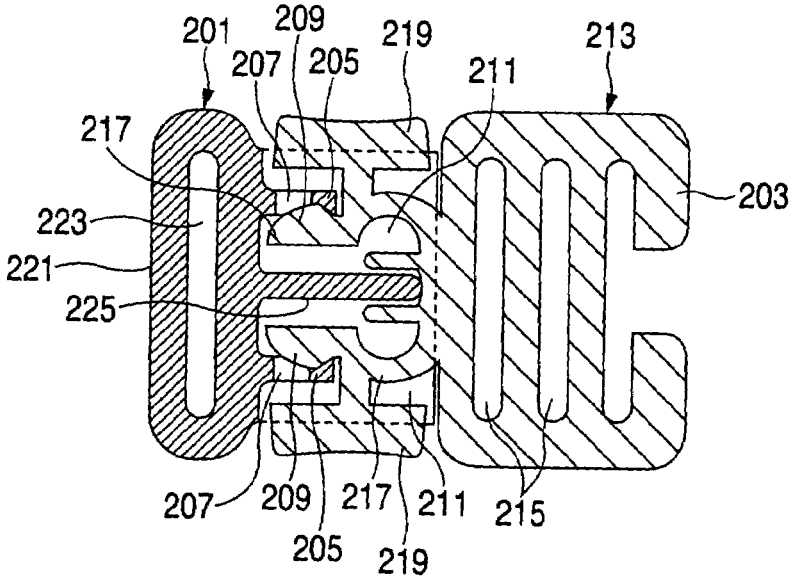
FIG. 16 is a perspective view showing another well-known buckle of an insertion type.

Next, a variant of the insertion member 2 shown in FIGS. 13 and 14 will be described. A pair of insertion leg portions 31 protruded from both sides of a base portion 30 are continuously provided with an operating rod 33 like a cantilever on the outside in the vicinity of an engaging portion 32 disposed on a tip, that is, from the tip side toward the base portion 30, and an operating portion 34 is provided on the tip of the operating rod 33. The operating portion 34 is formed to have a thickness increased gradually from an inside edge portion 46 toward an outside edge portion 47. A bilge-shaped guide portion 38 is provided on the upper surface of a guide rod 37 protruded forward from the center of the base portion 30, and a convex guide portion 39 extended straight in such a shape as to be protruded forward from the guide rod 37 is provided on the lower surface of the guide rod 37. Other structures are the same as those in the embodiment and a using manner is also identical.

The buckle according to the embodiment has the structure described above and can produce the following advantages with this structure.

According to the first aspect of the invention, a buckle body 1, which is a housing 10 formed of a resin, has an insertion port 15 on one end, a belt attachment portion 17 on another end, an opening portion 16 on both sides, and an engaged portion 20 in an inner part, an insertion member 2, which is formed of a resin, has a pair of flexible insertion leg portions 31 including a belt attachment portion 40 on one end and an engaging portion 32 on a tip at another end side, and an operating rod 33 , which is continuously provided on an outside of the insertion leg portion 31, extended like a cantilever from a tip side of the insertion leg portion 31 toward a base end side, wherein the operating rod 33 is provided with an operating portion 34 protruded from the opening portion 16 when the insertion member 2 is inserted into the buckle body 1.

In particular, the operating rod 33 provided backward like a cantilever from the tip side is continuously provided on both sides of the insertion leg portion 31, and the operating portion 33 protruded from the opening portion 16 in an insertion is provided on the operating rod 33. Consequently, it is possible to increase the effective length of the insertion leg portion 31 which can be deformed elastically. By minimizing the effective length, it is not necessary to increase the size of the insertion member 2 differently from a conventional product and it is possible to reduce the size of the buckle body 1. Moreover, there is no possibility that the insertion leg portion 31 might be broken. Thus, it is possible to produce such an advantage that an operation for fitting and removing the insertion member 2 can be carried out smoothly and easily.

According to the second aspect of the invention, in addition to the advantage of the first aspect of the invention, the engaging portion 32 is formed by a projection 45 protruded toward a surface and a back face on the tip of the insertion leg portion 31, and the engaged portion 20 is formed by a pair of protruded plates 21 protruded from internal surfaces on both sides of the buckle body 1 and provided transversely apart from each other. Further, according to the third aspect of the invention, a hole portion 22 extended straight is formed on tips of the left and right protruded plates 21 provided on a lower plate 12. Consequently, the engaging portion 32 provided in the insertion leg portion 31 of the insertion member 2 can be led to the engaged portion 20 of the buckle body 1 efficiently and smoothly. Moreover, it is possible to produce such an advantage that dust or water entering the buckle body 1 can be discharged quickly also in a state in which the insertion member 2 is inserted in the buckle body 1.

According to the forth aspect of the invention, in addition to the advantage of the first aspect of the invention, a space between the tips of the insertion leg portions 31 is small and a space on the base portion 30 side is large, and the insertion leg portion 31 itself is formed to be bent outward. Consequently, the insertion leg portion 31 of the insertion member 2 can be elastically deformed precisely and smoothly inward, that is, in such a direction that a pair of insertion leg portions 31 approach. Thus, it is possible to produce such an advantage that the operation for fitting and removing the insertion member 2 can easily be carried out.

According to the fifth aspect of the invention, in addition to the advantage of the first aspect of the invention, a slit 35 extended at a constant interval is provided between the insertion leg portion 31 and the operating portion 34. Consequently, it is possible to produce such an advantage that an excellent and fine appearance can be obtained while maintaining the effective length of the insertion leg portion 31.

According to the sixth aspect of the invention, in addition to the advantage of the first aspect of the invention, the operating portion 34 is formed to be gradually increased in thickness from the inside edge portion 46 to an outside edge portion 47, and is thicker than the insertion log portion 31. Consequently, a step is not formed between the insertion leg portion 31 and the inner edge of the operating portion 34. Therefore, it is possible to produce such an advantage that a smooth feel can be obtained in an inserting operation and other things are caught with difficulty.

According to the seventh aspect of the invention, in addition to the advantage of the first aspect of the invention, the inside edge portion 46 of the operating portion 34 is formed to have such a shape as to be coincident with an open edge of the opening portion 16 as seen on a plane. Consequently, a clearance is not generated between the inside edge portion 46 of the operating portion 34 and the open edge of the opening portion 16. Thus, it is possible to produce such an advantage that other things can be prevented from being caught between the inside edge portion and the open edge to disturb a pressing operation or a removing operation.

According to the eighth aspect of the invention, in addition to the advantage of the first aspect of the invention, a projection piece 36 protruded toward a tip of the operating rod 33 is provided on an outside of a pair of the insertion leg portions 31 at the base portion 30 side. Consequently, it is possible to produce such an advantage that a gap formed between the tip of the operating rod 33 and the base portion 30 of the insertion leg portion 31 can be reduced and other things can be prevented from entering through the gap to disturb the pressing operation or the removing operation.

According to the ninth aspect of the invention, in addition to the advantage of the eighth aspect of the invention, the operating portion 34 abuts on the projection piece 36 when the insertion leg portion 31 is bent outward. Consequently, the excessive outward bending of the insertion leg portion 31 can be hindered and the insertion leg portion 31 can be reinforced. Therefore, it is possible to produce such an advantage that the insertion leg portion 31 can be formed to have a small thickness so as to be easily deformed elastically and an operation for fitting and removing the insertion member 2 in/from the buckle body 1 and an operation for pressing the operating portion 34 can simply be carried out.

According to the tenth aspect of the invention, in addition to the advantage of the first aspect of the invention, a guide rod 37 is protruded from a center of the base portion 30 of the insertion member 2, guide portions 38 and 39 having different shapes are convexly provided from a surface and a back face of the guide rod 37 respectively, and guide grooves 24 and 25 capable of alternatively guiding the guide portions 38 and 39 are concavely provided on internal surfaces of an upper plate 11 and a lower plate 12 of the buckle body 1 respectively. Consequently, it is possible to produce such an advantage that both sides of the buckle body 1 and the insertion member 2 can be prevented from being inserted by mistake and an operation for inserting the insertion member 2 into the buckle body 1 can be carried out smoothly. Thus, the advantages produced by the invention are very remarkable.

What is claimed is:

1. A buckle comprising:

a buckle body, which is a housing formed of a resin, has an insertion port on one end, a belt attachment portion on another end, an opening portion on both sides, and an engaged portion in an inner part, an insertion member, which is formed of a resin, has a pair of flexible insertion leg portions including a belt attachment portion on one end and an engaging portion on a tip at an opposite end, and an operating rod, which is provided on an outside of the insertion leg portion, including an operating portion protruded from the opening portion when the insertion member is inserted into the buckle body, wherein the operating rod is connected to the tip at the opposite end of the insertion leg portion and is extended like a cantilever from the tip of the insertion leg portion toward a base end side.

2. The buckle according to claim 1, wherein the engaging portion is formed by a projection protruded toward a surface and a back face on the tip of the insertion leg portion, and the engaged portion is formed by a pair of protruded plates protruded from internal surfaces on both sides of the buckle body and provided transversely apart from each other.

3. The buckle according to claim 2, wherein a hole portion extended straight is formed on tips of the left and right protruded plates provided on a lower plate.

4. The buckle according to claim 1, wherein a space between the tips of the insertion leg portions is small and a space on the base portion side is large, and the insertion leg portion itself is formed to be bent outward.

5. The buckle according to claim 1, wherein a slit extended at a constant interval is provided between the insertion leg portion and the operating portion.

6. The buckle according to claim 1, wherein the operating portion is formed to be gradually increased in thickness from the inside edge portion to an outside edge portion, and is thicker than the insertion leg portion.

7. The buckle according to claim 1, wherein the inside edge portion of the operating portion is formed to have such a shape as to be coincident with an open edge of the opening portion as seen on a plane.

8. The buckle according to claim 1, wherein a projection piece protruded toward a tip of the operating rod is provided on an outside of a pair of the insertion leg portions at the base portion side.

9. The buckle according to claim 8, wherein the operating portion abuts on the projection piece when the insertion leg portion is bent outward.

10. The buckle according to claim 1, wherein a guide rod is protruded from a center of the base portion of the insertion member, guide portions having different shapes are convexly provided from a surface and a back face of the guide rod respectively, and guide grooves capable of alternatively guiding the guide portions are concavely provided on internal surfaces of an upper plate and a lower plate of the buckle body respectively.

11. A buckle comprising:

a buckle body, which is a housing formed of a resin, has an insertion port on one end, a belt attachment portion on another end, an opening portion on both sides, and an engaged portion in an inner part, an insertion member, which is formed of a resin, has a pair of flexible insertion leg portions including a belt attachment portion on one end and an engaging portion on a tip at another end side, and an operating rod, which is provided on an outside of the insertion leg portion, including an operating portion protruded from the opening portion when the insertion member is inserted into the buckle body, wherein the operating rod is connected to a tip side of the insertion leg portion and is extended like a cantilever from the tip side of the insertion leg portion toward a base end side, wherein the engaging portion is formed by a projection protruded toward a surface and a back face on the tip of the insertion leg portion, wherein the engaged portion is formed by a pair of protruded plates protruded from internal surfaces on both sides of the buckle body and provided transversely apart from each other, and wherein a hole portion extended straight is formed on tips of the left and right protruded plates provided on a lower plate.

12. A buckle comprising:

a buckle body, which is a housing formed of a resin, has an insertion port on one end, a belt attachment portion on another end, an opening portion on both sides, and an engaged portion in an inner part, an insertion member, which is formed of a resin, has a pair of flexible insertion leg portions including a belt attachment portion on one end and an engaging portion on a tip at another end side, and an operating rod, which is provided on an outside of the insertion leg portion, including an operating portion protruded from the opening portion when the insertion member is inserted into the buckle body, wherein the operating rod is connected to a tip side of the insertion leg portion and is extended like a cantilever from the tip side of the insertion leg portion toward a base end side, wherein the operating portion is formed to be gradually increased in thickness from the inside edge portion to an outside edge portion, and is thicker than the insertion leg portion.

* * * * *